United States Patent [19]

Patel et al.

[11] 3,976,128

[45] Aug. 24, 1976

[54] PLATE AND FIN HEAT EXCHANGER

[75] Inventors: Chhotubhai N. Patel, Richmond; Donald W. Scofield, Connersville, both of Ind.

[73] Assignee: Ford Motor Company, Dearborn, Mich.

[22] Filed: June 12, 1975

[21] Appl. No.: 586,449

[52] U.S. Cl. ..... 165/153; 165/174; 62/504; 62/525; 62/527

[51] Int. Cl.[2] ..... F28F 9/22; F25B 39/02

[58] Field of Search ..... 62/504, 525, 527; 165/141, 142, 174, 152, 153

[56] References Cited

UNITED STATES PATENTS

| | | | |
|---|---|---|---|
| 1,684,083 | 9/1928 | Bloom | 62/525 |
| 2,143,565 | 1/1939 | Minea | 62/525 X |
| 2,237,239 | 4/1941 | Smith | 62/525 |
| 3,605,882 | 9/1971 | Smith et al. | 165/153 X |
| 3,805,889 | 4/1974 | Coulidge | 165/153 |

FOREIGN PATENTS OR APPLICATIONS

| | | | |
|---|---|---|---|
| 114,624 | 2/1942 | Australia | 165/174 |

*Primary Examiner*—Charles J. Myhre
*Assistant Examiner*—Theophil W. Streule, Jr.
*Attorney, Agent, or Firm*—John J. Roethel; Keith L. Zerschling

[57] ABSTRACT

A plate and fin heat exchanger in the form of a refrigerant evaporator. The heat exchanger comprises a plate and fin structure providing alternately channels for the flow of refrigerant and spaces for the flow of air. An apertured inlet manifold is in communication with the refrigerant flow channels. A refrigerant distribution tube is inserted into the inlet manifold through the aperture in the latter. The distribution tube is provided with a series of orifices formed in the tube wall in register with the refrigerant flow channels.

The improvement comprises a construction and arrangement in which the orifices are directed toward the air inlet side of the heat exchanger. Preferably, the orifices are directed to the air inlet side of the heat exchanger at an acute angle to a horizontal plane, the angularity being on the order of 0° to 15° relative to the horizontal plane and below the latter.

4 Claims, 3 Drawing Figures

PLATE AND FIN HEAT EXCHANGER

BACKGROUND OF THE INVENTION

In a conventional plate-fin type heat exchanger, such as an evaporator, the nozzles or orifices of the distribution tube within the inlet manifold are longitudinally aligned with the passageways or channels in the plate structure. The refrigerant is directly discharged into the channels in such a manner that the refrigerant contacts the cooling surfaces substantially equally between the air stream inlet and outlet sides. It was suggested by Clifton Briner, a co-worker of the herein-named inventors, that calculations indicated an improvement in performance could be expected if the refrigerant distribution was weighted so that more refrigerant contacts the heat exchanger surface which is first contacted by the air stream then by the air stream leaving the heat exchanger or evaporator.

Accordingly, the present invention is directed toward an improved distribution tube orientation for controlling the refrigerant distribution so that more refrigerant contacts the channel walls on the higher temperature air intake side of the heat exchanger than contacts the channel walls on the lower temperature air discharge side.

SUMMARY OF THE INVENTION

The present invention relates to a plate and fin heat exchanger in the form of a refrigerant evaporator, comprising a plate and fin means providing alternately channels for flow of refrigerant and spaces for the flow of air. An apertured inlet manifold means is in communication with the refrigerant flow channels and has a refrigerant distribution tube inserted therein. The tube has a series of orifices formed in the tube wall in register with the refrigerant flow channels. An important feature of the present invention is that the orifices are directed toward the air inlet side of the heat exchanger thereby causing more refrigerant to contact the heat exchanger surface which is first contacted by the air stream passing through the fins than contacts the heat exchanger surfaces contacted by the air stream leaving the heat exchanger.

Preferably, the orifices are directed to the air inlet side of the heat exchanger at an acute angle to a horizontal plane, the angle being not less than 0° nor more than 15° relative to the horizontal plane and below the latter.

DESCRIPTION OF THE DRAWING

Further features and advantages of the present invention will be made more apparent as this description proceeds, reference being had to the accompanying drawing, wherein.

DETAILED DESCRIPTION OF THE INVENTION

Figure 1:
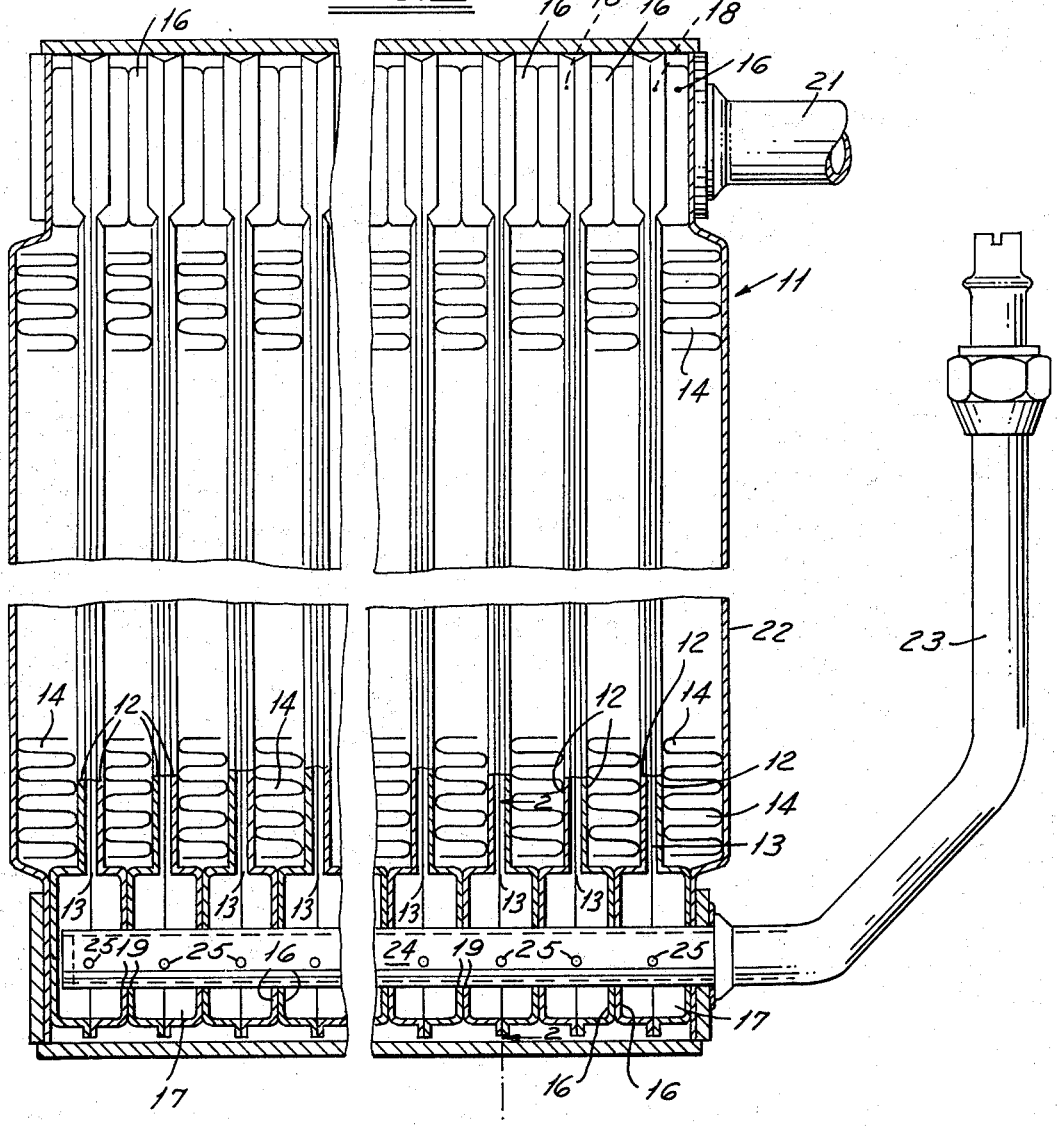
FIG. 1 is a view in part sectional of a heat exchanger, an evaporator, in accordance with the present invention.

Referring now to the drawing, FIG. 1 shows a plate and fin heat exchanger, generally designated 11, in the form of an evaporator particularly adapted for use in an automobile air conditioning system. The evaporator 11 comprises a stack of formed plates 12, pairs of which are placed in face to face relation so that adjacent pairs provide alternately channels 13 for flow of refrigerant and spaces 14 for the flow of air. Heat transfer fins 15 are positioned within the air spaces to provide increased heat transfer area, as is well known in the art.

The ends 16 of the adjacent pairs of the plates 12 are formed to provide inlet and outlet headers 17 and 18, respectively. As best seen at the lower end of the evaporator 11, the headers 17 and 18 are walled chambers that are in direct communication with the channels 13. The headers 17 and 18 have in their side walls aligned apertures 19 providing communication between the respective header chambers. The outlet headers 18 are in communication with an outlet pipe 21 mounted on the end plate 22 of the heat exchanger or evaporator 11.

The inlet headers 17, as distinguished from the outlet headers 18, are substantially isolated from one another. At best seen in FIG. 1, a refrigerant inlet pipe 23 has a blind end tubular portion 24 that projects through the chambers of the inlet headers 17. The diameter of the end portion 23 is a slipfit through the apertures 19 in the walls of the chambers. Through this construction and arrangement the chambers of the inlet headers 17 are substantially isolated from each other, any leakage between the tubular end portion 24 and the edges of the apertures 19 being insignificant in the overall operation of the heat exchanger.

The inlet tube portion 24 has a plurality of discharge orifices 25 that are in longitudinal alignment along the length thereof. The orifices 25 are in register or vertical alignment with the refrigerant channels 13.

An important feature of the present invention is the orientation of the orifices for discharge of the refrigerant. It has been the practice to position the orifices at the upper side of the refrigerant inlet tube, such as the tube 24, in vertical alignment with the refrigerant channels 13. This would correspond to the position marked V in FIG. 3.

Figure 2:
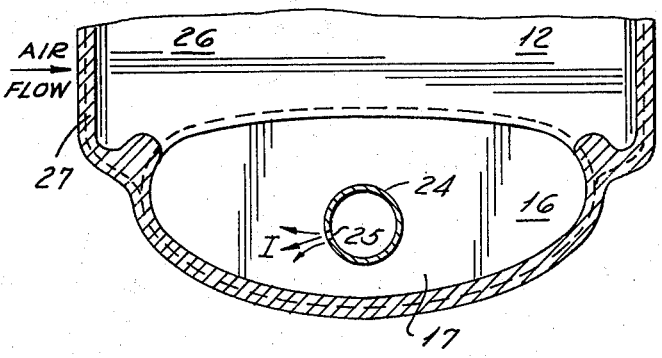
FIG. 2 is a section view on the line 2—2 of FIG. 1.

It has been suggested that an improvement in performance could be expected if the refrigerant distribution was weighted so that more refrigerant contacts the heat exchanger (evaporator) surfaces which are first contacted by the air stream entering the evaporator (see air flow arrow to the left of FIG. 2) than by the air stream leaving the evaporator. For example, this would indicate that the orifices 25 should not be located in a direction clockwise of the position V, such as the position VI.

Figure 3:
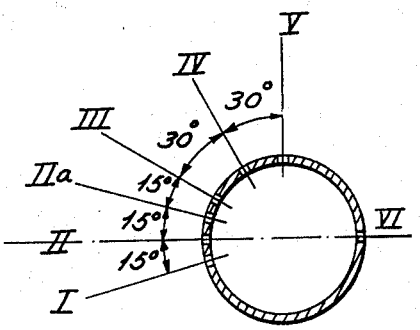
FIG. 3 is an enlarged cross section of the distribution tube indicating various positions to which the discharge orifices were rotated in determining maximum performance.

FIG. 3 illustrates a plurality of positions counterclockwise of the position V that would appear to satisfy the requirement of permitting more refrigerant to contact the surfaces first contacted by the air stream. It will be understood that the surfaces involved are primarily the plate 12 area 26 immediately inwardly of the end flange 27 forming the end wall of the refrigerant channel 13.

We have determined that the maximum cooling effect is achieved by positioning the orifices at or between the positions I and II. Position II is at a 0° angle. That is, the axis of the orifice 25 lies in a horizontal reference plane indicated by the line 28. Position I lies at an acute angle of 15° relative to and below the horizontal plane. Either position I or II yields a heat transfer greater than distributor tubes with orifices 25 positioned at positions III or IV.

The testing of an improved evaporator embodying the present invention was done by utilizing an inlet tube that could be rotated to the different orifice positions. Typical B.t.u. output of a complete evaporator with the distributor tube changing orientation to the positions I to VI, inclusive, was as follows:

| | |
|---|---|
| I — 18,391 B.t.u. | III — 17,029 B.t.u. |
| I — 18,197 B.t.u. | IV — 17,248 B.t.u. |
| IIa — 17,583 B.t.u. | V — 17,312 B.t.u. |
| VI —15,571 B.t.u. | |

It was also found that the outlet temperature of the refrigerant was quite stable at 45°F in distributor positions I and II but was very unstable in positions III and IV. The stability of the output temperature at a desired 45°F was a specification requirement for the evaporator use contemplated.

It is to be understood this invention is not limited to the exact construction illustrated and described above, but that various changes and modifications may be made without departing from the spirit and scope of the invention as defined by the following claims.

We claim:

1. A plate and fin heat exchanger in the form of a refrigerant evaporator, comprising:

plate and fin means providing alternately channels for flow of refrigerant and spaces for the flow of air, an apertured inlet manifold means in communication with the refrigerant flow channels, and a refrigerant distribution tube inserted through the manifold means aperture into the inlet manifold means, the tube having a series of orifices formed in the tube wall in register with the refrigerant flow channels, the orifices being directed toward the air inlet side of the heat exchanger at an acute angle to a horizontal plane.

2. A plate and fin heat exchanger according to claim 1, in which:

the acute angle is 0° to 15° relative to the horizontal plane and below the latter.

3. A plate and fin heat exchanger in the form of a refrigerant evaporator for cooling an air stream flowing therethrough, comprising:

a stack of formed plates, adjacent pairs of the plates providing alternately channels for flow of refrigerant and spaces for the flow of air, the adjacent pairs of plates having inlet and outlet headers at the ends thereof forming chambers in communication with the refrigerant flow channels, fin means within the air spaces, and a refrigerant inlet tube projecting through the inlet header chambers and isolating one from the other, the inlet tube having a plurality of discharge orifices with at least one orifice in each inlet header chamber in register with a refrigerant flow channel, wherein the improvement comprises:

the orifices being oriented to discharge refrigerant laterally from the inlet tube toward the side of the heat exchanger first contacted by the air stream entering the fin means, the orifices being in longitudinal alignment along the length of the inlet tube and directed radially thereof at an acute angle below the horizontal.

4. A plate and fin heat exchanger according to claim 3, in which:

the orifices are directed toward the headers at an angle of 0° to 15° below the horizontal.

* * * * *